US005614691A

United States Patent [19]

Taylor

[11] Patent Number: 5,614,691

[45] Date of Patent: Mar. 25, 1997

[54] STRIKING MECHANISM FOR SEMI-AUTOMATIC OPERATION OF RIFLES AND THE LIKE

[75] Inventor: James M. Taylor, Prosperity, Pa.

[73] Assignee: Robert I. Landies, Chardon, Ohio

[21] Appl. No.: 445,004

[22] Filed: May 19, 1995

[51] Int. Cl.[6] ..... F41C 27/00

[52] U.S. Cl. ..... 89/128; 89/154; 89/181; 89/189; 89/191.01; 42/69.03

[58] Field of Search ..... 89/128, 147, 154, 89/181, 189, 190, 191.01; 42/69.03

[56] References Cited

U.S. PATENT DOCUMENTS

| | | | |
|---|---|---|---|
| 1,073,452 | 9/1913 | White | 89/128 |
| 1,178,468 | 4/1916 | Hartigan | 89/128 |

OTHER PUBLICATIONS

*Catalog and Hand Book –Colt Automatic Machine Guns; Colt Automatic Machine Rifles; Colt Aircraft Machine Guns and Equipment* (*Browning Patents*) By: Colt's Patent Fire Arms MFG. Company Hartford, Conn., U.S.A. (26 pages) Undated.

*Primary Examiner*—J. Woodrow Eldred

*Attorney, Agent, or Firm*—Renner, Kenner, Greive, Bobak, Taylor & Weber

[57] ABSTRACT

A striking mechanism (20) for the semi-automatic operation of a cartridge firing firearm (10) providing, in combination, a receiver (12); a barrel (11) attached to the receiver; a gas operated slide assembly (13) providing a slide (14) movable within the receiver; a magazine (19), supplying a plurality of cartridges (29), carried by the receiver; and a trigger assembly (26) attached to the receiver and providing a hammer (28); the striking mechanism comprising a bolt (21) reciprocable within the receiver and engageable with the breach (32) of the barrel and the face of a cartridge chambered therein, the bolt carrying a primary firing pin (22); a bolt lock (23) pivotally linked to the bolt for selectively locking the bolt within the receiver; a secondary firing pin assembly (24) pivotally linked to the bolt lock and to the slide, the secondary firing pin assembly providing a secondary firing pin (25), engageable with the hammer and the primary firing pin thereby to strike the primer of a cartridge chambered within the barrel. The present invention also includes a method for converting gas operated cartridge firing firearms (10) from fully automatic operation to semi-automatic operation comprising removing the bolt link, hammer and trigger assembly from the fully automatic firearm; providing a bolt (21) reciprocable within the receiver (12) of the firearm, engageable with the breach (32) of the barrel (11) and the face of a cartridge chambered therein and carrying a primary firing pin; providing a bolt lock (23) pivotally connected to the bolt for selectively locking the bolt within the receiver; providing a trigger assembly (26) having a trigger (16) and a hammer (28) selectively movable once in response to rearward movement of the trigger; and providing a secondary firing pin assembly (24) between the bolt lock and the slide, said assembly being interposed between the bolt and the hammer and providing a secondary firing pin (25) engageable with the hammer and the primary firing pin thereby to strike the primer of a cartridge chambered within the barrel in response to rearward movement of the trigger.

18 Claims, 7 Drawing Sheets

STRIKING MECHANISM FOR SEMI-AUTOMATIC OPERATION OF RIFLES AND THE LIKE

TECHNICAL FIELD

This invention relates to a striking mechanism for rifles that provides a semi-automatic operation whereby a single cartridge is fired with each pull of the trigger. More particularly the striking mechanism has been designed and adapted for use in an originally fully automatic firearm. The striking mechanism of the present invention is only capable of semi-automatic operation and has been designed to inhibit conversion of the firearm back to fully automatic operation. Methods for the conversion of cartridge firing firearms from fully automatic operation to semi-automatic operation are also provided. Additionally the present invention provides an assembly for the semi-automatic operation of a cartridge firing firearm.

BACKGROUND OF THE INVENTION

There has always been interest in collecting and shooting weapons that have been developed for and used by the military, both handguns and rifles. This interest is held by many civilians, particularly those who served in the military. Because many of the firearms are capable of fully automatic fire, private ownership is both a right and a privilege and is available to qualified, law-abiding individuals who, in accordance with federal law, acquire a Class II or III Firearms Dealer license or those individuals who apply for and obtain the requisite permission from the local authority where they reside and the BATF to become the registered owner of a NFA (National Firearms Act) firearm.

Semi-automatic firearms, on the other hand, are not subject to as rigorous a procedure to own and fire legally and in fact, can currently be legally transferred between individuals. While there is a good selection of handguns and rifles capable of semi-automatic operation, including some "civilian" versions of military firearms, original fully automatic firearms are not readily available in semi-automatic versions. The reasons are numerous including cost of the original firearm, costs to convert it, the necessity for a gunsmith or armorer to perform the work and, the realization on the part of one who has legally acquired such a firearm that the value is often seriously diminished by conversion to semiautomatic operation. Notwithstanding the foregoing reasons, there is a desire for original firearms that have been legally converted to semi-automatic operation and are thus, more readily acquired.

One such firearm is a rifle known as the Browning Automatic Rifle, Caliber 30, Model 1918, which is a gas operated, air cooled automatic arm. Expanding gases from the ignition of powder furnish the energy for the operation or cycling of the rifle. Immediately after firing, as the bullet traverses the barrel and passes an internal gas port prior to exiting from the muzzle, the live gases expand through the gas port into the gas tube or cylinder to impinge against the head of a piston. In so doing, the piston within the gas cylinder is forced rearwardly, toward the buttstock, driving a slide which cycles a combination of internal components while compressing a recoil spring for the return movement.

The slide is configured to pass around the magazine and provides a rear base which engages the hammer. Slots within the receiver are provided to guide reciprocal movement of the slide, rearwardly with the firing of a cartridge and then forwardly to load a subsequent cartridge. The hammer is also pivotally connected to the bolt link, which is, in turn, pivotally connected to the bolt lock. As the slide begins to travel rearwardly, the hammer does so which causes the bolt link to rotate in a clockwise fashion, thereby pulling down on the bolt lock which immediately unlocks the bolt from the receiver. The bolt carries the firing pin, as well as the extractor for removing the empty cartridge from the chamber and the extraction begins concurrently. Once free from the mating receiver surfaces, the bolt now travels rearwardly with the bolt link and hammer as the slide completes its rearward most travel. In so doing, several additional operations continue. The spent cartridge finally clears the chamber and immediately encounters the ejector which applies a lateral force against the head of the cartridge, ejecting it through an opening in the right side of the receiver provided therefor. The slide contacts a buffer in the buttstock, halting its rearward movement, and immediately begins return travel in response to the compression of the recoil spring. Forward movement is now a function of the position of the trigger and the change lever, as will be detailed later.

Assuming the rifle is in the automatic mode and the trigger remains depressed, the continued forward movement of the bolt strips a fresh round from the magazine, eventually chambering it. As the slide moves forward, the bolt link, hammer and bolt lock do likewise until the very last increment of movement. The bolt has just seated the cartridge, which limits its forward movement while the bolt link is caused to rotate counter-clockwise and as it raises within the receiver, thereby lifting the bolt lock into locking engagement within the top of the receiver at which stage, the bolt cannot move rearwardly. At the same instant, the hammer completes it clockwise rotation abruptly, slamming into the head of the firing pin which protrudes from the rear of the bolt. This action causes the firing pin to strike the primer of the chambered cartridge, thereby firing it whereby the sequence is repeated in response to sustained depression of the trigger or until the ammunition becomes exhausted.

Repeat of this cycle is dependent upon the position of the change lever in the automatic position and, the trigger remaining in the fired position. If the operator releases the trigger, the sear is immediately raised into the path of the reciprocating slide. In rearward travel, the slide can push the sear down to pass over it. However, upon the return, the sear is raised by a spring and engages a recess in the underside of the slide which halts its continued forward movement. When this occurs, the action remains opened, and no new round is loaded. Accordingly, the Browning rifle is one which fires from the open bolt and as soon as the trigger is again pulled, the sear is pulled out of the recess, allowing the slide to move forward causing all of the foregoing operations. The bolt closes, taking with it a fresh round from the magazine, which is simultaneously chambered and instantaneously thereafter fired, as the foregoing sequence is allowed to repeat.

If the change lever is positioned for semi-automatic operation, the sear immediately arrests the return movement of the slide after a single cartridge is fired, locking the bolt and action open, with no round chambered. To continue firing, the trigger is first released. When it is subsequently pulled, the sear is removed, the slide proceeds forward and a round is chambered and fired as the hammer finally contacts the head of the firing pin. As should be apparent, while the firearm can be fired in the semi-automatic mode, it is just as readily changed back to automatic operation and hence, all of the ownership restrictions apply.

Basically, the art has not provided a facile means or device by which the Browning Automatic Rifle can be essentially permanently converted to semi-automatic only operation. Accordingly, there is a need for a striking mechanism that is capable of rendering the Browning Automatic Rifle a semi-automatic firearm. Moreover, to comply with the existing federal law such a firearm must meet BATF approval which is given where the Bureau determines that the firearm is not readily converted back to fully automatic operation.

SUMMARY OF INVENTION

It is therefore, an object of the present invention to provide striking mechanism for a cartridge firing firearm that was originally designed to operate fully automatic, which allows only semi-automatic operation.

It is another object of the present invention to provide a striking mechanism for the Browning Automatic Rifle that allows only semi-automatic operation.

It is yet another object of the present invention to provide a striking mechanism for the Browning Automatic Rifle that cannot readily be converted back to full automatic operation.

It is still another object to provide a striking mechanism that employs many of the original components to cycle the action, so that the gas firing principals are still employed.

It is still another object to provide a striking mechanism that fires semi-automatically from the closed bolt position.

It is yet another object to provide an assembly for the semi-automatic operation of a cartridge firing firearm.

It is still another object to provide a method for converting a fully automatic firearm to semi-automatic operation that is permissible to own and transfer as a Class I firearm.

It is still another object to provide a method for converting a fully automatic firearm from open bolt to closed bolt firing and semi-automatic operation.

At least one or more of the foregoing objects, together with the advantages thereof over the known art relating to firearms and firing mechanisms therefor, which shall become apparent from the specification which follows, are accomplished by the invention as hereinafter described and claimed.

In general the present invention provides a striking mechanism for the semi-automatic operation of a cartridge firing firearm providing, in combination, a receiver; a barrel attached to the receiver; a gas operated slide assembly, providing a slide movable within the receiver; a magazine, supplying a plurality of cartridges, received by the receiver; and a trigger assembly attached to the receiver and providing a hammer. The striking mechanism comprises bolt means reciprocable within the receiver and engageable with the breach of the barrel and the face of a cartridge chambered therein, the bolt carrying a primary firing pin; bolt lock means pivotally connected to the bolt means for selectively locking the bolt means within the receiver; a secondary firing pin assembly pivotally connected to the bolt lock means and to the slide, the secondary firing pin assembly providing a secondary firing pin, engageable with the hammer and the primary firing pin thereby to strike the primer of a cartridge chambered within the barrel.

The present invention also includes an assembly for the semi-automatic operation of a cartridge firing firearm providing a receiver; a barrel attached to the receiver; a gas operated slide assembly providing a slide movable within the receiver; a magazine supplying a plurality of cartridges, carried by the receiver; a trigger assembly attached to the receiver and providing a hammer; bolt means reciprocable within the receiver and engageable with the breach of the barrel and the face of a cartridge chambered therein, the bolt carrying a primary firing pin; and bolt lock means pivotally linked to the bolt means for selectively locking the bolt means within the receiver. The assembly comprises body means providing a head, and lower leg, a front face and a rear leg; a bore passing longitudinally between the rear leg and the front face; and, secondary firing pin means slidably received within the bore, the firing pin means being biased to protrude through the rear leg and movable through the body when struck by the hammer, thereby contacting the primary firing pin to provide the energy to fire a cartridge.

The present invention also includes a method for converting a cartridge firing firearm from fully automatic operation to semi-automatic operation. For firearms providing a bolt reciprocable within a receiver, engageable with the breach of the barrel and the face of a cartridge chambered therein and carrying a primary firing pin, slide means movable within the receiver, a bolt lock pivotally connected to the bolt for selectively locking the bolt within the receiver, a bolt link, a hammer and a trigger assembly, the method comprises removing the bolt link, hammer and trigger assembly from the fully automatic firearm; providing a trigger assembly having a trigger and a hammer selectively movable once in response to rearward movement of the trigger; and providing a secondary firing pin assembly between the bolt lock means and the slide means, said assembly being interposed between the bolt means and the hammer and providing a secondary firing pin engageable with the hammer and the primary firing pin thereby to strike the primer of a cartridge chambered within the barrel in response to rearward movement of the trigger.

The present invention also includes a method for converting a cartridge firing firearm from fully automatic operation to semi-automatic operation comprising providing a bolt reciprocable within the receiver of the firearm, engageable with the breach of the barrel and the face of a cartridge chambered therein and carrying a primary firing pin; providing bolt lock means pivotally connected to the bolt for selectively locking the bolt within the receiver; providing a trigger assembly having a trigger and a hammer selectively movable once in response to rearward movement of the trigger; and providing a secondary firing pin assembly between the bolt lock means and the slide, said assembly being interposed between the bolt means and the hammer and providing a secondary firing pin engageable with the hammer and the primary firing pin thereby to strike the primer of a cartridge chambered within the barrel in response to rearward movement of the trigger.

PREFERRED EMBODIMENT FOR CARRYING OUT THE INVENTION

Figure 1:
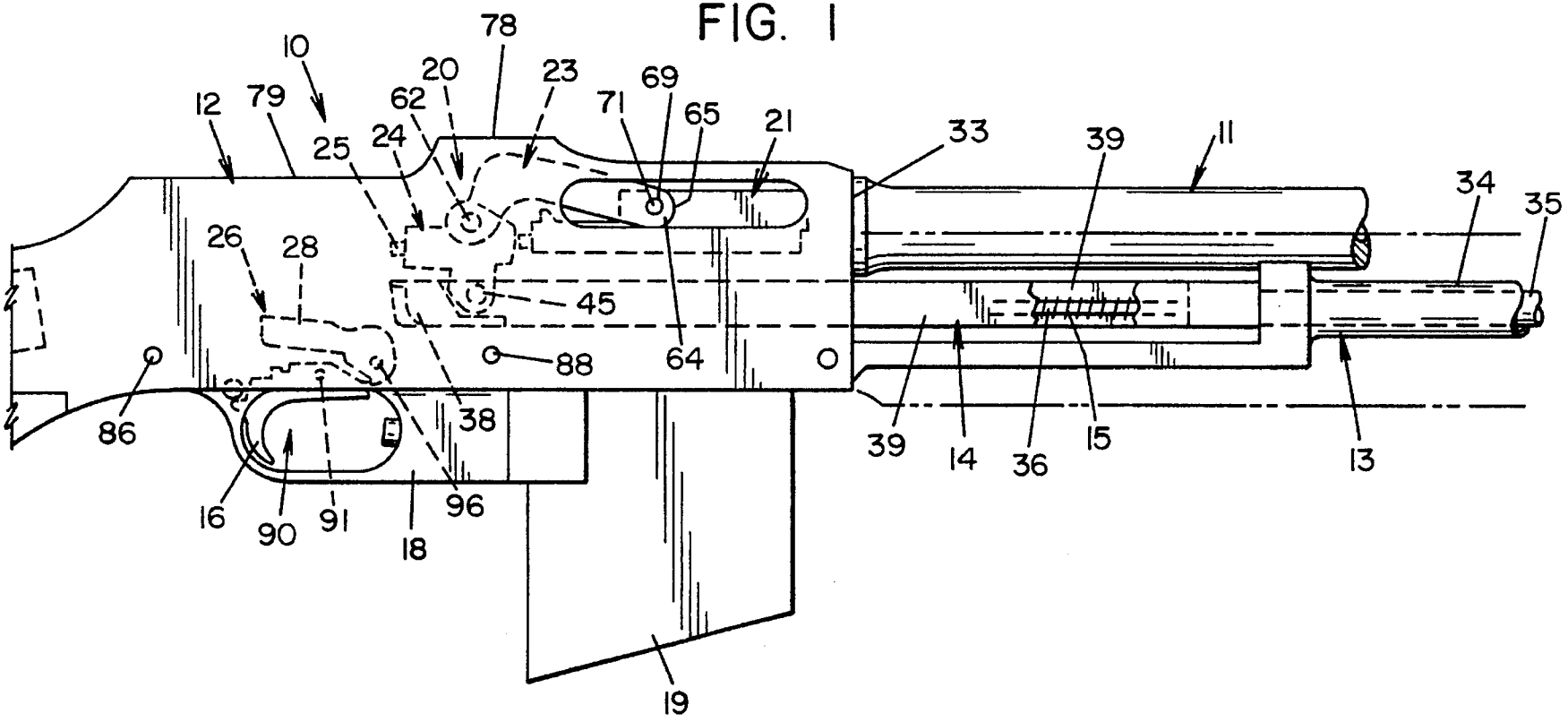
FIG. 1 is a side elevation of a portion of a rifle, depicting the receiver, trigger and trigger housing, a magazine in place and sections of the barrel and gas cylinder.

The striking mechanism according to the present invention has been adopted for usage in an automatic rifle originally capable of select fire between fully automatic and semi-automatic operation. Fully automatic fire, or true "automatic" occurs when the trigger of the firearm is pulled or depressed without release and a plurality of cartridges are continuously cycled through the rifle, each being fired in succession until either the trigger is released or the supply of cartridges has been exhausted. As soon as the trigger is released, firing ceases; when it is again depressed automatic firing re-commences, assuming a remaining supply of cartridges. Semi-automatic fire is that operation which fires but a single cartridge or round every time the trigger is depressed, whether it is held or released. Once the trigger is released, components of the striking mechanism are re-aligned for the next "pull" of the trigger, whereupon another cartridge is fired. Generally, the cycling of the mechanism is faster than the trigger can be manipulated by the human finger and accordingly, in semi-automatic operation, the firearm can only be fired as fast as the trigger is pulled. Fully automatic operation by comparison is considerably faster.

The striking mechanism of the present invention has been designed for use in an automatic rifle as a replacement for the original striking mechanism that allowed select fire. One such rifle in particular is the Browning Automatic Rifle, Caliber 30, Model 1918 or M1918, including the known model variations. A portion of such a rifle is depicted in FIGS. 1–5 and 7–8 and is indicated generally by the numeral 10. The rifle or firearm 10 includes a barrel 11, threadably carried by a receiver 12. A gas operated assembly, indicated generally by the numeral 13, is carried beneath the barrel 11 which provides a conduit and housing for the movement of the slide 14 which is driven rearwardly, away from the muzzle of the barrel, by gases formed when a cartridge is fired to cycle a bolt and is then driven forward by the decompression or release of a return spring 15.

The forward and return movement of the slide 14 cycles internal components, commonly referred to as the action, to extract and eject a fired cartridge, strip a fresh cartridge from a clip, magazine or the like and chamber it while simultaneously cocking a hammer mechanism for subsequent release and firing of the fresh cartridge. The receiver also provides the trigger and trigger housing, 16 and 18 respectively, and the magazine 19 which provides a plurality of cartridges. Rearwardly of the trigger housing, to the left in FIG. 1, is provided a buttstock (not shown) which allows shoulder firing of the rifle, as is conventional with all styles and types of rifles.

At this point it is to be understood that the original Browning Automatic Rifle was provided with a striking mechanism (not shown) that allowed select fire operation. As noted hereinabove, private ownership of such firearms is restricted by federal law to Class II and III Firearms Dealers and those citizens who apply for and obtain the requisite permission from the local authority where they reside and the BATF to become the registered owner of a NFA (National Firearms Act) firearm. By converting the select fire rifle to permanent semi-automatic operation, the rifle can be owned by qualified and approved citizens without registration as an NFA firearm.

Figure 2:
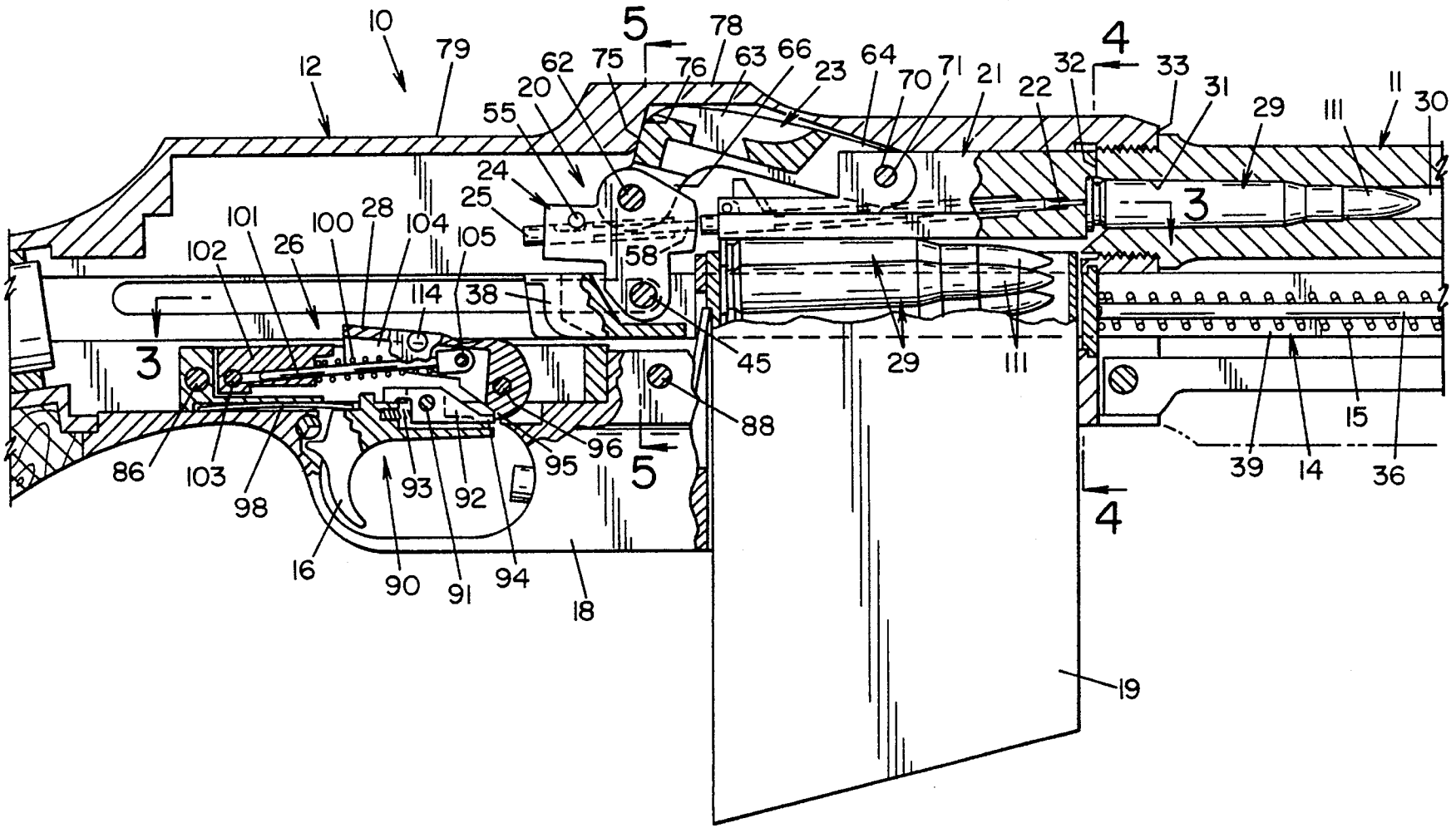
FIG. 2 is an enlarged side elevation of a portion of a rifle, similar to FIG. 1 and partially in cross-section, depicting the internal components thereof and the striking mechanism of the present invention.

The present invention provides such a conversion by the means of a novel striking mechanism, as depicted in FIG. 2 and indicated generally by the numeral 20. The striking mechanism 20 includes the bolt 21, which houses the firing pin 22; the bolt lock 23 and, the secondary firing pin assembly generally 24, which provides a secondary firing pin 25. The striking mechanism 20 is housed within the receiver 12, which is preferably machined to accept it but not to accept the original striking mechanism and accordingly, the rifle 10 is not readily converted back to "automatic" select fire operation. The striking mechanism 20 is cycled by a modified slide 14, as will be described in greater detail hereinbelow, and is activated by a trigger assembly, indicated generally by the numeral 26, which is also a replacement for the trigger assembly (not shown) employed in the original select fire rifle. The trigger assembly includes the hammer 28 which engages the secondary firing pin 25 to initiate the firing of a cartridge 29.

Before proceeding with a detailed description of the striking mechanism 20, a general discussion pertaining to the interaction of the other components will be useful. With reference to Figs. I and 2, the barrel 11 provides a rifled bore 30 and a chamber 31 at the end or breach 32, for receipt of a cartridge 29. The breach 32 is typically threaded into the front 33 of receiver 12. Immediately below the barrel 21 is the gas cylinder 34 of the gas operated assembly 13 which conducts spent gases from firing of the cartridge through a vent in the barrel (not shown) against a gas piston 35 which is connected to the slide 14. The piston is hollow and houses the return spring 15 which is mounted on a return spring guide rod 36 (FIG. 1), rigidly carried by the receiver. The spring provides the energy to return the slide which, as will be explained hereinbelow, charges the rifle, closes and locks the bolt whereupon it is ready for the next firing. The slide 14 provides a front base (not shown) and a rear base 38, separated by a pair of opposed rails 39 (FIG. 4) which straddle the magazine 19. The base 38 carries the secondary firing pin assembly 24 which is pivotally connected thereto by a pin 45.

Figure 6:
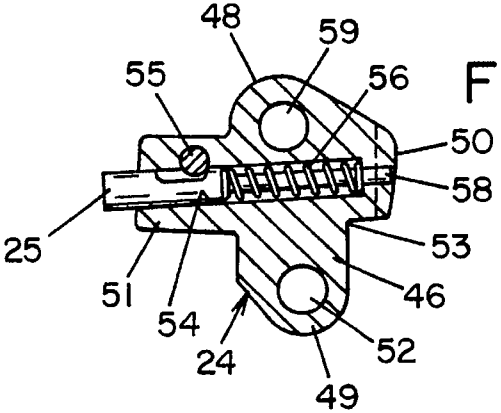
FIG. 6 is a side elevation, partially in section, depicting the secondary firing pin assembly of the striking mechanism of the present invention.
Figure 4:
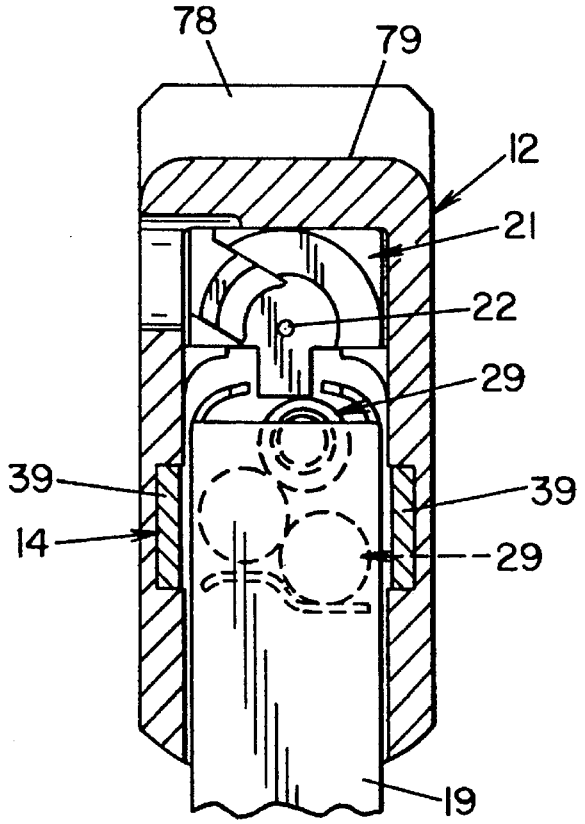
FIG. 4 is a cross-section taken substantially along the line 4—4 of FIG. 2.
Figure 5:
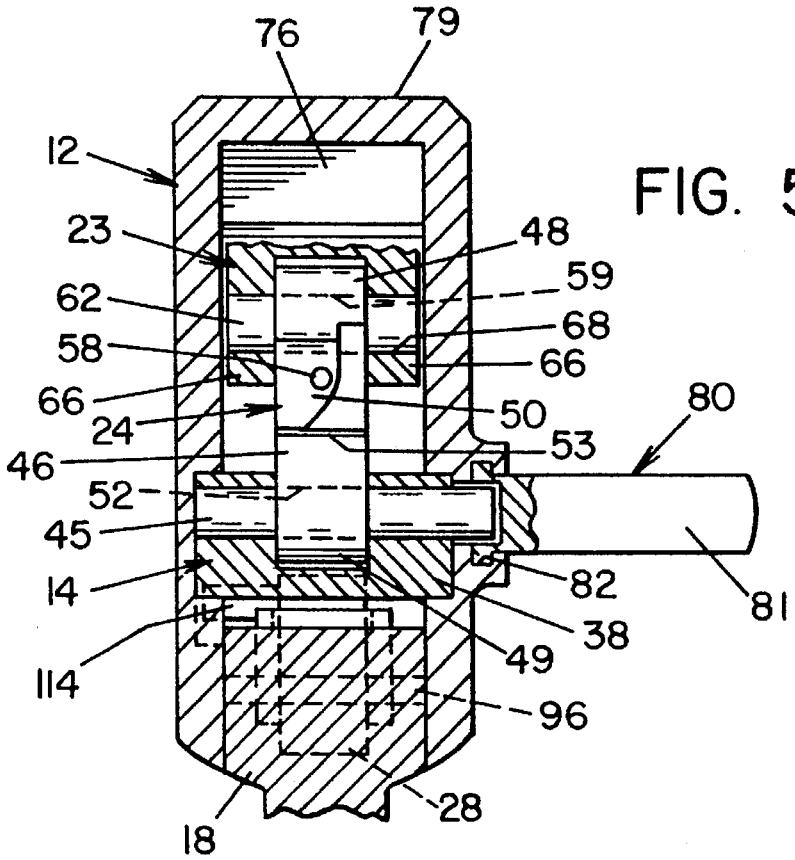
FIG. 5 is a cross-section taken substantially along the line 5—5 of FIG. 2.

With reference to FIG. 6, the assembly 24 comprises a body 46 providing a head 48, and lower leg 49, a front face 50 and a rear leg 51. The lower leg 49 carries a bore 52, for receipt of pin 45. Between the lower leg 49 and front face 50 a notch 53 is provided which allows the body 46 to rotate about pin 45 downwardly into the slide as the action cycles. The secondary firing pin 25 is slidably received within an appropriately configured bore 54 passing longitudinally between the rear leg 51 and front face 50. The firing pin 25 is held within the bore 54 with a pin 55 and a compression spring 56 encircles the forward portion of the firing pin 25 within the bore 54 to bias the latter rearwardly. The base of the firing pin 25 protrudes through the rear leg 51 at rest but is capable of being driven through the body 46, when contacted by the hammer 28, so that its narrower head 58 emerges from the front face 50 momentarily until the spring 56 returns it to rest, as appears in FIG. 6.

Figure 3:
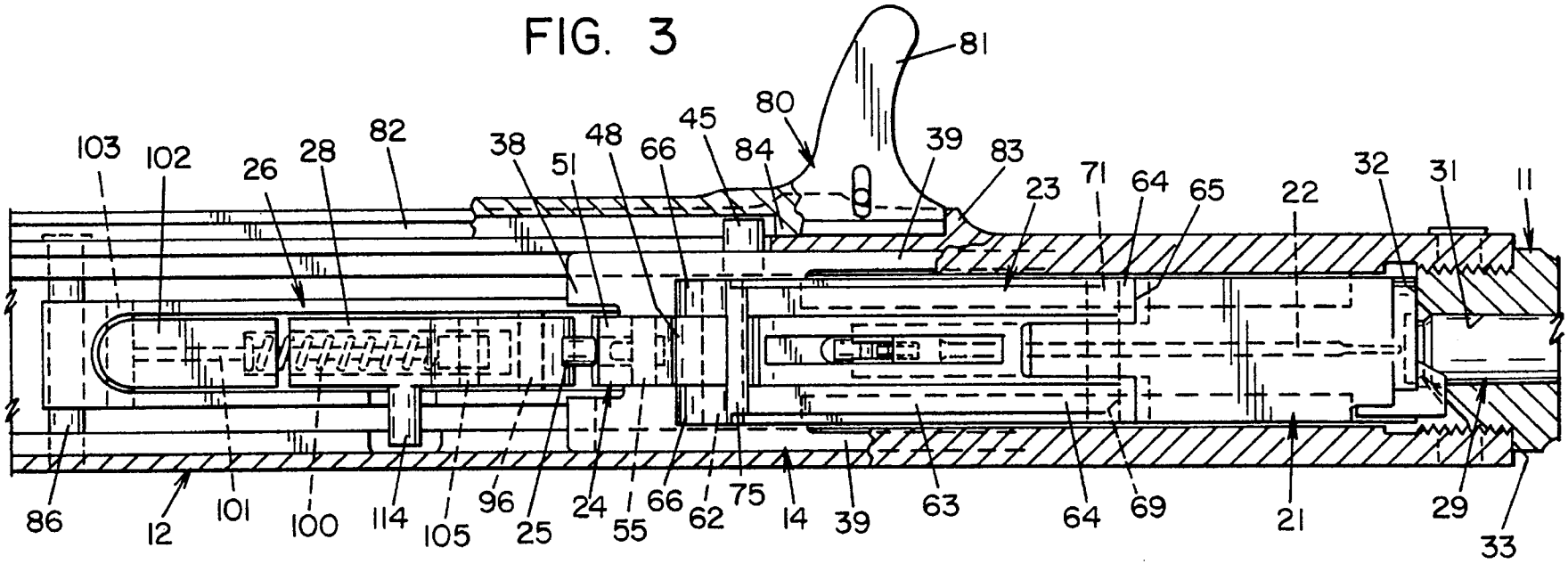
FIG. 3 is a cross-section taken substantially along the line 3—3 of FIG. 2.

The head 48 of assembly 24 provides a bore 59 for receipt of a pin 62 which pivotally connects the bolt lock 23 to the assembly 24. With reference to FIG. 3, the bolt lock 23 comprises an elongate body 63, terminating in a pair of ears 64 at the head or upper end 65 of the body and providing a second pair of ears 66, extending downwardly from the body, between which the head 48 of assembly 24 is located. The ears 66 carry a bore 68 (FIG. 5) that is coaxial with the bore 59 for receipt of pin 62 by which the assembly 24 is connected. In similar fashion, the ears 64 at the head 65 carry a bore 69 (FIG. 3) that is coaxial with a bore 70 carried in the bolt 21 for receipt of a pin 71 which pivotally connects the bolt lock 23 to the bolt 21.

As best depicted in FIG. 2, the bolt lock 23 assumes a kneeling position when it and the bolt 21 are locked in battery. The base 75 of bolt lock 23 abuts a ramped surface 76 accommodated by a characteristic hump 78 in the upper wall 79 of receiver 12. The mating surfaces 75 and 76 are angled slightly from perpendicular, approximately 13°, to allow the bolt lock 23 to be pulled downwardly when unlocking and to slide upwardly into the locked position. This design was customary with the original Browning Automatic Rifle and is employed in the striking mechanism 20 of the present invention.

In order to cycle the action without firing, for loading and clearing, a cocking lever 80 is provided which presents a handle 81 at the left side of the receiver 12. The cocking lever 80 reciprocates within a longitudinal recess 82, cut into the left side of the receiver. A stop 83 is provided at the forward edge of recess 82 and defines a rest or home position for the lever 80. The lever carries a lug 84 on its inner side which is engageable with the pin 45, which connects the secondary firing assembly 24 to the slide 14 and extends through the left side of the slide and the recess 82. Pulling rearwardly on the handle 81, charges the rifle, or clears it when the magazine is empty or removed, by drawing the slide 14 and assembly 24 rearwardly. The initial movement of components causes the assembly to rotate, drawing the bolt lock 23 downwardly to unlock the bolt 21. Subsequently, the bolt is moved rearwardly and extracts any cartridge within the chamber. As the bolt is allowed to move forwardly, due to the recoil spring 15, it eventually closes on the chamber and the handle 82 is returned to the rest or closed position.

With reference again to FIG. 2, the trigger assembly 26 shall be described next. As with many of the components of the rifle, the trigger assembly 26 is removably held in the receiver by pins 86 and 88. It should be noted that the striking mechanism 20 is not designed to operate with the original trigger mechanism of the Browning Automatic Rifle, which did not include a hammer. The trigger assembly 26 is thus modified or replaced with a trigger mechanism indicated generally by the numeral 90, which includes the trigger 16 and the hammer 28. The design of trigger mechanism 90 is based on the Model M1 Carbine, also .30 Caliber, but .30 Caliber carbine, as opposed to the 30-06 round fired by the Browning Automatic Rifle.

The trigger 16 is pivotally carried within trigger mechanism 90 via pin 91, and co-operates with a sear 92, biased for limited rotational movement by a spring 93. Sear 92 provides a tip 94 which is engageable with a lip 95, carried by the hammer 28. The hammer is also pivotally carried within the trigger mechanism 90 via pin 96 and provides a round base which is rotatable within the mechanism 90 so that the opposite end of the hammer can rotate between a 9:00 o'clock position prior to firing and a 12:00 o'clock position when fired (FIG. 7B). It will be appreciated that the trigger 16 is returned to its rest position by the action of a leaf spring 98. Meanwhile, the hammer 28 is driven or powered by a hammer spring 100 which encircles a hammer strut 101, one end of which is held within a hammer block 102, mounted within mechanism 90 via pin 103, while the opposite end is held within a notch 104 in the hammer 28 via pin 105. Limited rotation of the strut 101 and hammer block 102 is thereby permitted to allow rotation of the hammer through its operating cycle.

Figure 7A:
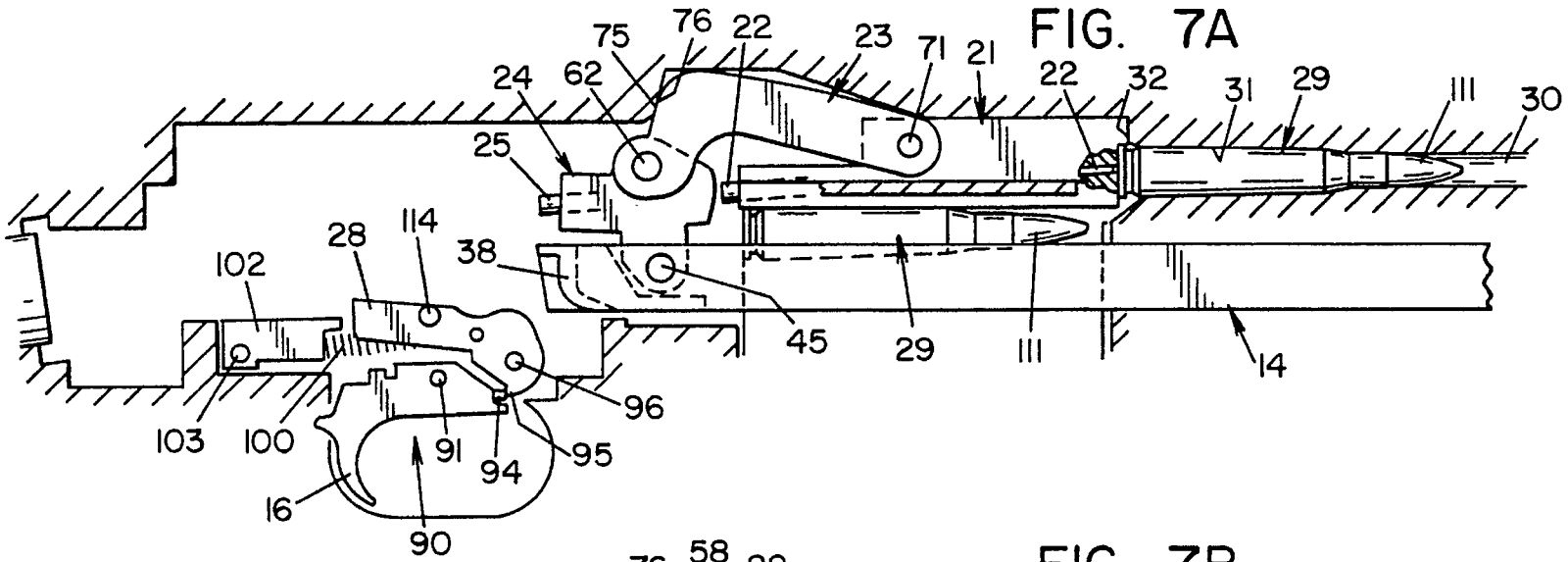
FIGS. 7A–7E are a series of schematic views depicting the striking mechanism of the present invention during sequential stages of operation.
Figure 7B:
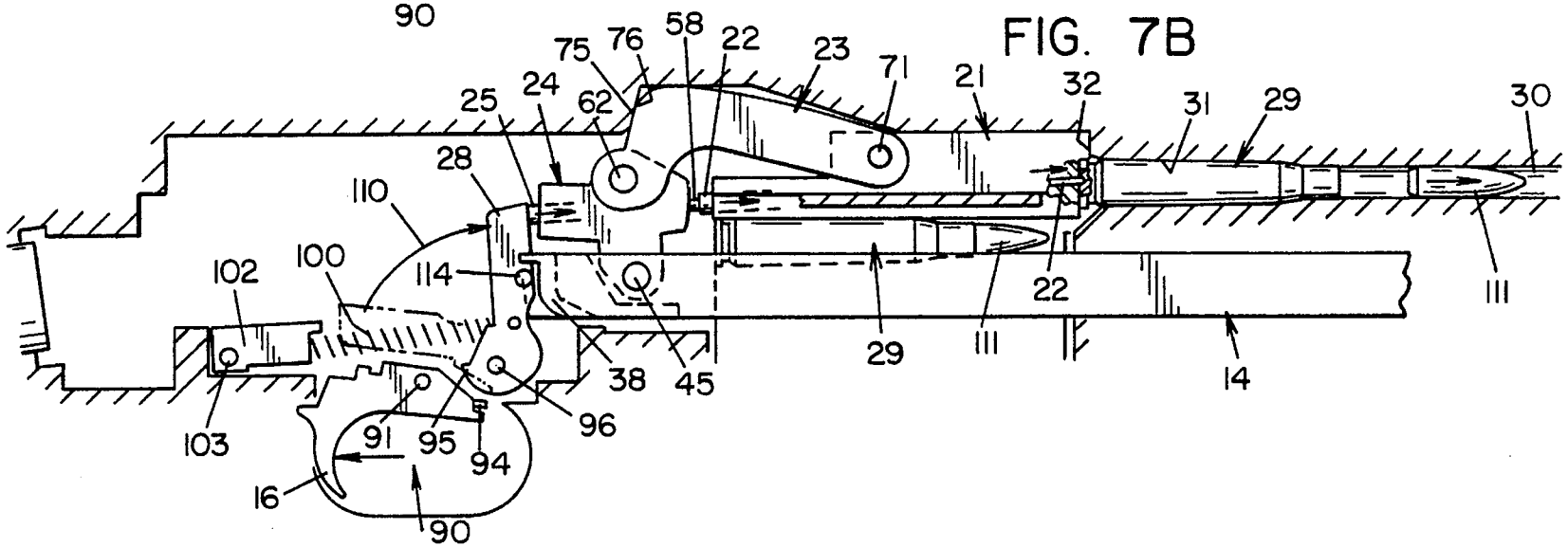
Figure 7C:
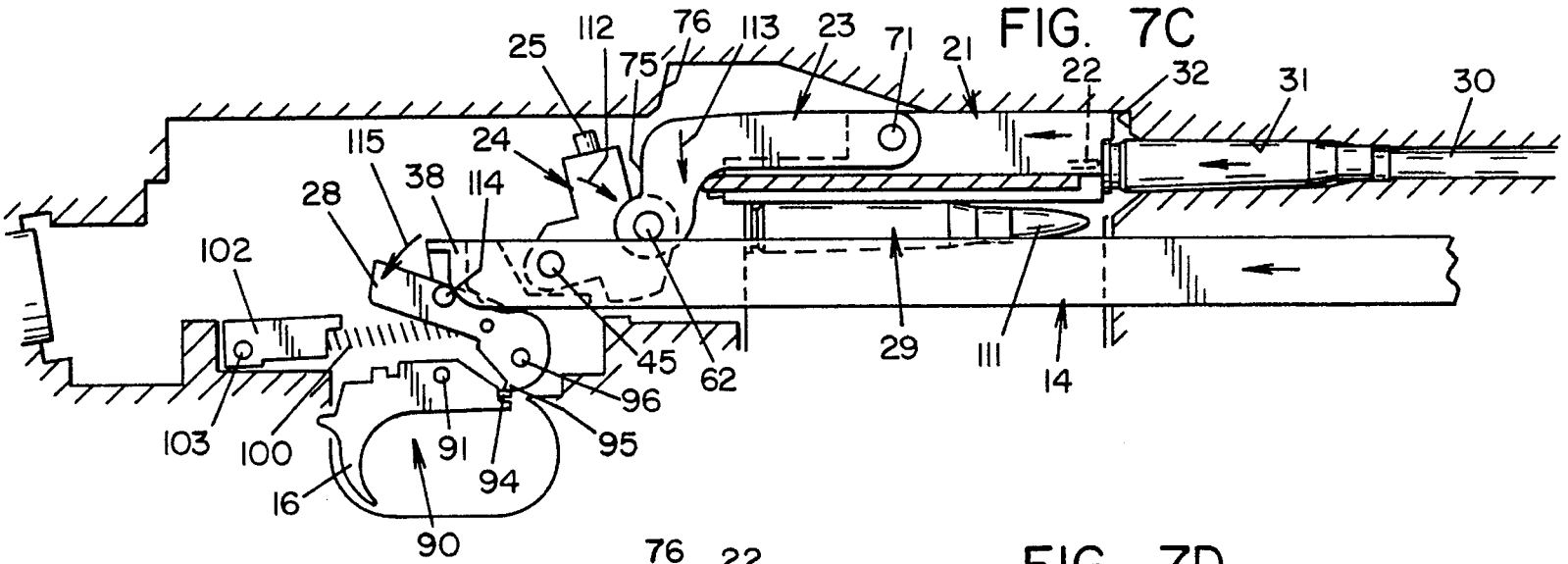

Firing the rifle can be viewed with reference to FIGS. 2 and 7A–7E. As the trigger 16 is pulled rearwardly, the sear 92 rotates clockwise sufficiently for tip 94 to release the lip 95 of hammer 28. In FIGS. 7A–7E, as well as FIG. 8, the overall action and interrelated components have been depicted somewhat schematically for simplification and the trigger 16 and sear 92 have been combined as one unit. In addition, springs 93 and 98 have not been depicted nor, have several of the other components, for which reference can be made to FIG. 2. Thus, the loaded position of the rifle, prior to firing, is depicted in Figs. 2 and 7A. As the trigger 16 is pulled, the hammer is released and rotates clockwise, in the direction of the arrow 110. The hammer 28 strikes the secondary firing pin 25 within assembly 24, which strikes the primary firing pin 22, to strike the primer of the chambered cartridge and fire the bullet 111, as depicted in FIG. 7B.

Figure 7D:
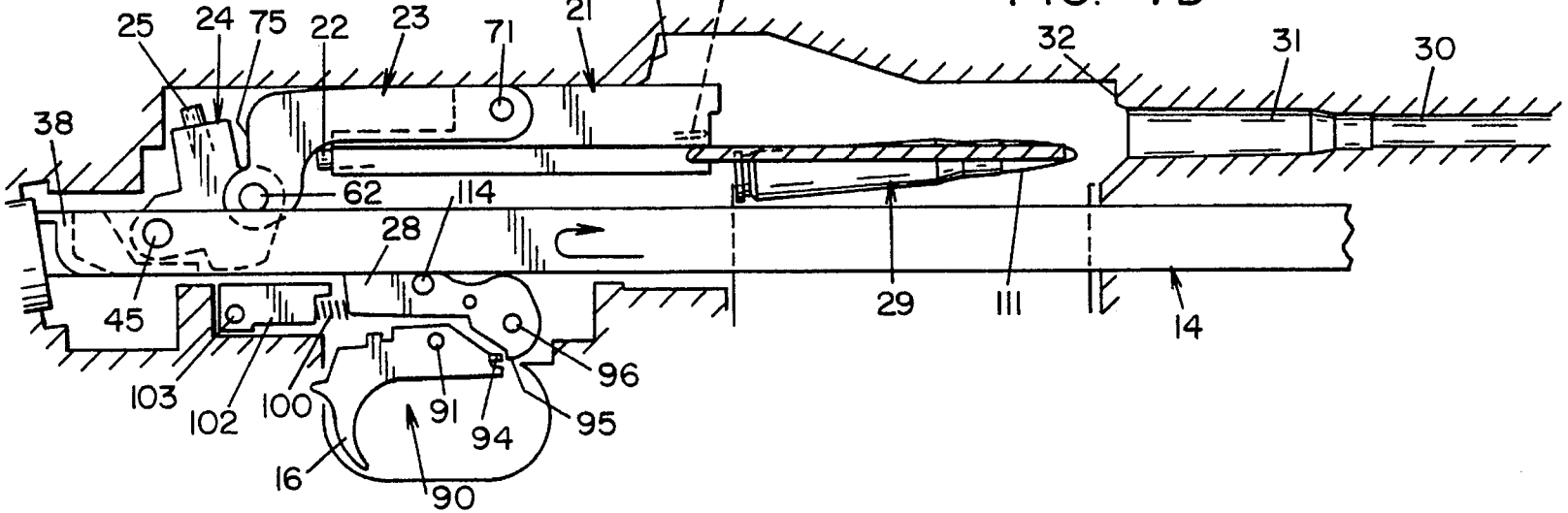
Figure 7E:
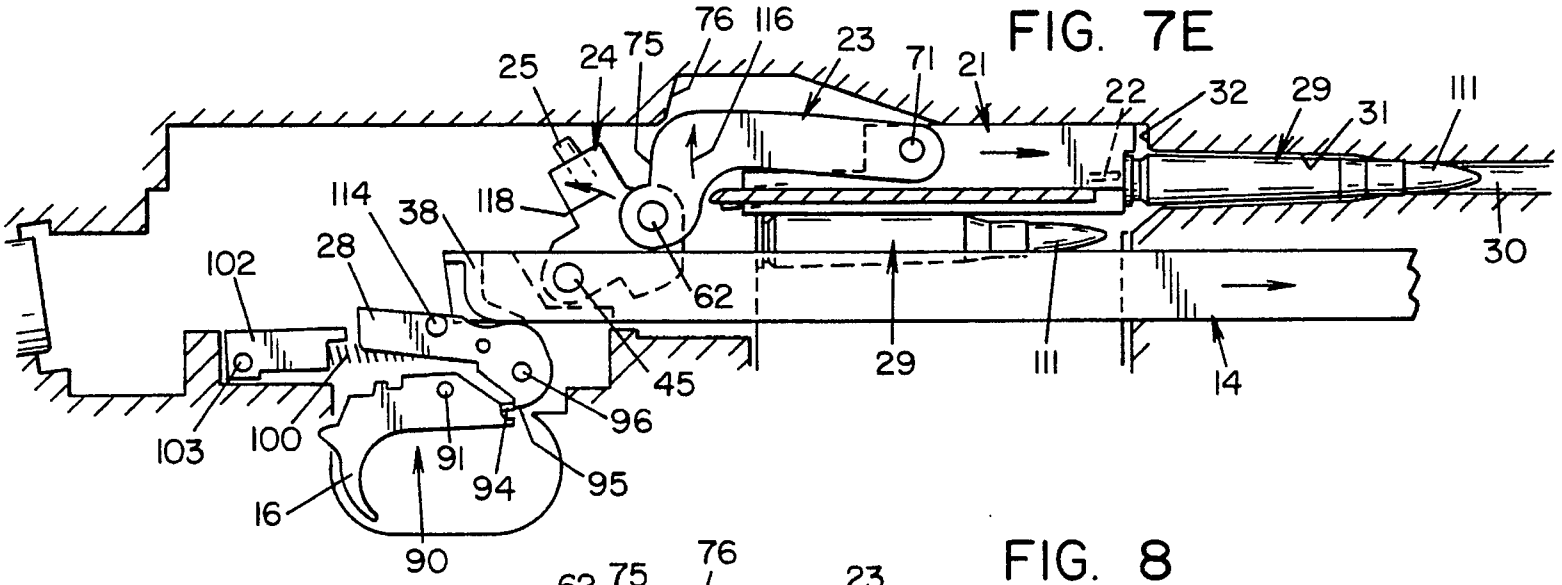

Immediately thereafter, the gases are partially expelled into the gas chamber which initiates rearward movement of the piston 35 and slide 14, as described hereinabove. As the slide 14 travels rearwardly (FIG. 7C), the secondary firing pin assembly 24 rotates clockwise, in the direction of the arrow 112, pulling the bolt lock 23 downwardly, in the direction of the arrow 113. Rearward movement of the slide 14 causes the slide base 38 to engage a pin 114 passing through the hammer 28 to rotate the hammer in the direction of the arrow 115 and cock it. In FIG. 7D, the slide 14, has reached its rearwardmost travel, the empty cartridge case has been ejected from the rifle and the hammer 28 is essentially horizontal, in the 9:00 o'clock position. The action of the recoil spring 15 then returns the slide 14 to the closed or home position, stripping a new cartridge 29 from the magazine 19 for chambering.

During locking of the bolt 21 (FIG. 7E), the bolt lock 23 is finally rotated upwardly, arrow 116, and the secondary firing pin assembly 24 begins counterclockwise rotation, arrow 118, until the locked position depicted in FIG. 7A is again obtained. The rifle is thus, ready to fire upon the next pull of the trigger 16 and it will be appreciated that firing takes place from the closed bolt position.

Figure 8:
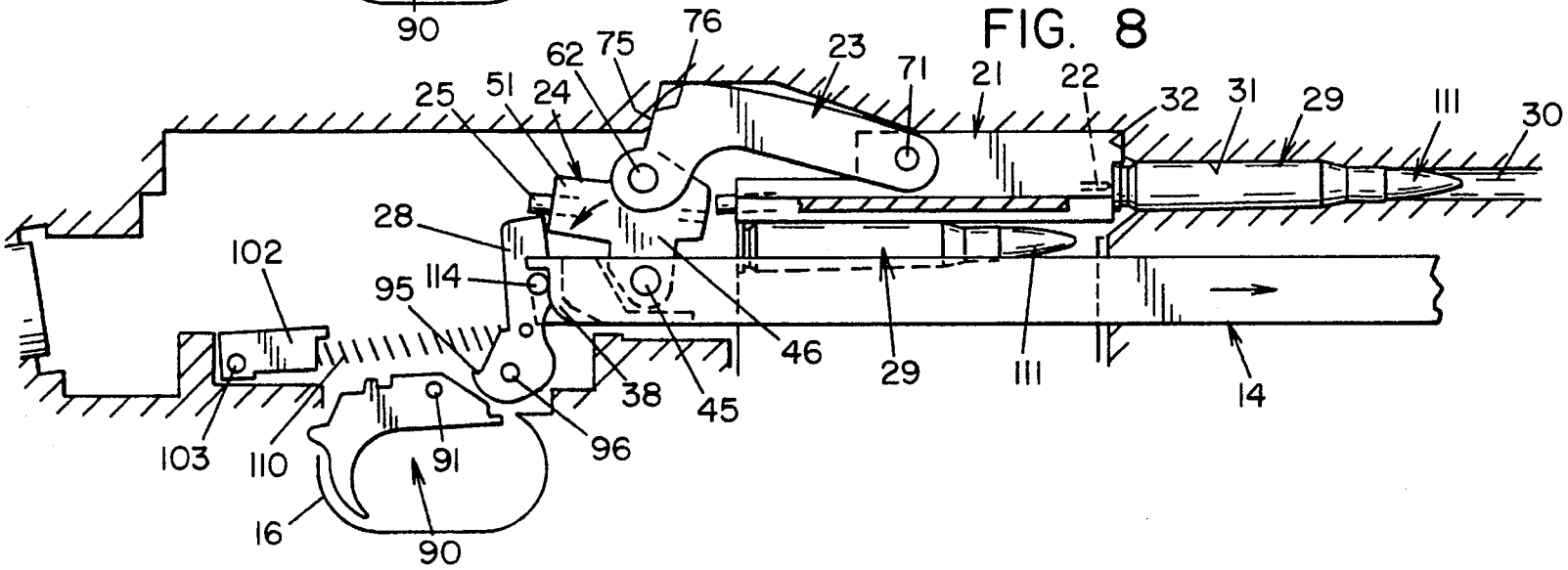
FIG. 8 is another schematic view depicting the striking mechanism of the present invention in a position incapable of firing where the trigger has not been released.

If there has been any attempt to alter the engagement of the tip of sear 94 and hammer lip 95, or should the tip break or wear, the hammer 28 does not lock in the 9:00 o'clock position of FIGS. 2 and 7A and instead follows the secondary firing pin assembly 24 closed with the slide 14. As depicted in FIG. 8, with the tip of sear 94 removed, the hammer 28 arrives too soon and abuts the rear leg 51 of body member 46 rather than the secondary firing pin 25. Hence, the rifle does not fire on closing and is therefore, incapable of fully automatic operation. Furthermore, the action cannot be re-cocked because the hammer 28 cannot be locked in a pre-strike or cocked position (FIG. 2) irrespective of the position of the trigger and thus, semi-automatic operation is also disabled. To return the rifle to operation, will necessitate replacement of the component(s) improperly modified or worn and thus, the rifle is not capable of fully automatic operation.

The method of the present invention for converting the full automatic action of the Browning Automatic Rifle, or similar firing firearms to semi-automatic operation involves the steps of removing at least the hammer and trigger assembly from the fully automatic action and providing a bolt 21 reciprocable within the receiver 12 of the firearm, engageable with the breach 32 of the barrel 11 and the face of a cartridge 29 chambered within the barrel, and carrying a primary firing pin 22. Next, is providing a bolt lock 23 pivotally connected to the bolt for selectively locking the bolt within the receiver; then providing a trigger assembly 26 having a trigger 16 and a hammer 28 selectively movable once in response to rearward movement of the trigger. Finally, the method requires providing a secondary firing pin assembly 24 between the bolt lock and the slide, the assembly being interposed between the bolt lock and the hammer and providing a secondary firing pin 25 engageable with the hammer and the primary firing pin thereby to strike the primer of a cartridge chambered within the barrel in response to rearward movement of the trigger 16.

For a firearm, such as the Browning Automatic Rifle, which provides a slide, a bolt 21 reciprocable within a receiver 12, engageable with the breach 32 of the barrel 11 and the face of a cartridge chambered therein and carrying a primary firing pin 22, a bolt lock 23 pivotally connected to the bolt means for selectively locking the bolt means within the receiver, a hammer and a trigger assembly, the method of the present invention for converting from fully automatic operation to semi-automatic operation comprises the steps of removing at least the hammer and trigger assembly from the fully automatic action and providing a trigger assembly 26 having a trigger 16 and a hammer 28 selectively movable once in response to rearward movement of the trigger. Next, the method requires providing a secondary firing pin assembly 24 between the bolt lock 23 and the slide 14, the assembly being interposed between the bolt lock and the hammer and providing a secondary firing pin 25 engageable with the hammer and the primary firing pin 22 thereby to strike the primer of a cartridge chambered within the barrel in response to rearward movement of the trigger 16.

As should be apparent from the foregoing description, both of the foregoing methods are accomplished by substitution of the striking mechanism 20 according to the present invention, and the trigger mechanism 90, for the components of the original rifle that comprised the striking mechanism for select fire operation and the original trigger mechanism. Although not necessarily detailed in the drawings, the semi-automatic striking mechanism 20 can be essentially permanently fitted to the rifle, although removable for cleaning and repair operations, by re-tooling the receiver 12. More particularly, while it is desirable to provide a receiver that will operate with the original barrel design, gas tube, buttstock and internal components, such as the bolt 21 and bolt lock 23, in the preferred embodiment, the receiver is altered sufficiently so as to no longer accommodate the original components that allowed select fire operation. In this manner, BATF regulations are satisfied because the rifle cannot readily be converted back to full automatic operation merely by acquiring and re-installing the original components.

Components that can be readily remanufactured to work with the striking mechanism of the present invention include the receiver 12 and the slide 14. Making the receiver narrower internally than the original design will readily prohibit the reintroduction of original components, as will moving several of the slots, bores and recesses for assembly and movement of internal component parts. Use of a different slide will also inhibit restoration of the fully automatic action. Moreover, the use of the novel secondary striking pin assembly 24 ensures that the striking mechanism cannot be readily modified to allow fully automatic operation of the firearm.

Thus it should be evident that the striking mechanism 20 and secondary firing pin assembly 24 of the present invention are useful for providing semi-automatic operation of cartridge firing firearms. The invention is particularly suited for use with the Browning Automatic Rifle, but is not necessarily limited thereto. Similarly, the striking mechanism and secondary firing pin assembly of the present invention can be used with existing components of automatic firearms as well as with modifications thereof. In addition, the methods of the present invention allow the conversion of select fire firearms to semi-automatic operation. The methods also can be employed for the permanent conversion of select fire firearms to semi-automatic operation. By substituting more of the components of the original automatic firearm, such as, for instance the receiver and the slide, restoration of the fully automatic action will also be more completely inhibited.

Based upon the foregoing disclosure, it should now be apparent that the use of the striking mechanism and secondary firing pin assembly described herein will carry out the objects set forth hereinabove. Similarly, substitution of components from the fully automatic action are optional steps in the methods taught by the present invention for the conversion from fully automatic operation to semi-automatic, which make the conversion more acceptable under the existing law. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A striking mechanism for the semi-automatic operation of a cartridge firing firearm providing, in combination, a receiver; a barrel attached to said receiver; a gas operated slide assembly providing a slide movable within said receiver; a magazine, supplying a plurality of cartridges, carried by said receiver; and a trigger assembly attached to said receiver and providing a hammer; said striking mechanism comprising:

bolt means reciprocable within said receiver and engageable with the breach of said barrel and the face of a cartridge chambered therein, said bolt carrying a primary firing pin;

bolt lock means pivotally linked to said bolt means for selectively locking said bolt means within said receiver;

a secondary firing pin assembly pivotally linked to said bolt lock means and to said slide, said secondary firing pin assembly providing a secondary firing pin, engageable with said hammer and said primary firing pin thereby to strike the primer of a cartridge chambered within said barrel; and cocking means reciprocable within said receiver and engageable with said secondary firing pin assembly for manual operation of said striking mechanism.

2. A striking mechanism for the semi-automatic operation of a cartridge firing firearm providing, in combination, a receiver; a barrel attached to said receiver; a gas operated slide assembly providing a slide movable within said receiver; a magazine, supplying a plurality of cartridges, carried by said receiver; and a trigger assembly attached to said receiver and providing a hammer; said striking mechanism comprising:

bolt means reciprocable within said receiver and engageable with the breach of said barrel and the face of a cartridge chambered therein, said bolt carrying primary firing pin;

bolt lock means providing an elongate body, a first pair of opposed ears at one end and a second pair of ears at the other end, pivotally linked to said bolt means for selectively locking said bolt means within said receiver;

a secondary firing pin assembly pivotally linked to said bolt lock means and to said slide, said secondary firing pin assembly providing a secondary firing pin, engageable with said hammer and said primary firing pin thereby to strike the primer of a cartridge chambered within said barrel.

3. A striking mechanism, as set forth in claim 1, wherein said first pair of ears are pivotally connected to said bolt lock means.

4. A striking mechanism, as set forth in claim 1, wherein said second pair of ears are pivotally connected to said secondary firing pin assembly.

5. A striking mechanism, as set forth in claim 1, wherein said body of said bolt lock means provides a base engageable with a mating surface in said receiver.

6. A striking mechanism for the semi-automatic operation of a cartridge firing firearm providing, in combination, a receiver; a barrel attached to said receiver; a gas operated slide assembly providing a slide movable within said receiver; a magazine, supplying a plurality of cartridges, carried by said receiver; and a trigger assembly attached to said receiver and providing a hammer; said striking mechanism comprising:

bolt means reciprocable within said receiver and engageable with the breach of said barrel and the face of a cartridge chambered therein, said bolt carrying a primary firing pin;

bolt lock means pivotally linked to said bolt means for selectively locking said bolt means within said receiver; and a secondary firing pin assembly pivotally linked to said bolt lock means and to said slide, said secondary firing pin assembly comprising body means providing a head, and lower leg, a front face and a rear leg;

a bore passing longitudinally between said rear leg and said front face; and secondary firing pin means slidably received within said bore, said secondary firing pin means being engageable with said hammer and primary firing pin and biased to protrude through said rear leg and movable through said body when struck by the hammer, thereby contacting said primary firing pin to provide the energy to fire a cartridge chambered within said barrel.

7. A striking mechanism, as set forth in claim 6, wherein said secondary firing pin assembly further comprises a first pin for pivotally connecting said lower leg to said slide and a second pin for pivotally connecting said head to said bolt.

8. An assembly for the semi-automatic operation of a cartridge firing firearm providing, in combination, a receiver; a barrel attached to said receiver; a gas operated slide assembly providing a slide movable within said receiver; a magazine, supplying a plurality of cartridges, carried by said receiver; a trigger assembly attached to said receiver and providing a hammer; bolt means reciprocable within said receiver and engageable with the breach of said barrel and the face of a cartridge chambered therein, said bolt carrying a primary firing pin; and bolt lock means pivotally linked to said bolt means for selectively locking said bolt means within said receiver; said assembly comprising:

body means providing a head, and lower leg, a front face and a rear leg;

a bore passing longitudinally between said rear leg and said front face; and secondary firing pin means slidably received within said bore, said firing pin means being biased to protrude through said rear leg and movable through said body when struck by the hammer, thereby contacting said primary firing pin to provide the energy to fire a cartridge.

9. An assembly, as set forth in claim 8, further comprising a first pin for pivotally connecting said lower leg to said slide and a second pin for pivotally connecting said head to said bolt.

10. A method for converting cartridge firing firearms from fully automatic operation to semi-automatic operation, said firearms providing bolt means reciprocable within a receiver, engageable with the breach of the barrel and the face of a cartridge chambered therein and carrying a primary firing pin, slide means movable within the receiver, bolt lock means pivotally connected to the bolt means for selectively locking the bolt means within the receiver, a bolt link, a hammer and a trigger assembly, the method comprising:

removing the bolt link, hammer and trigger assembly from the fully automatic firearm;

providing a trigger assembly having a trigger and a hammer selectively movable once in response to rearward movement of said trigger;

providing a secondary firing pin assembly between the bolt lock means and the slide means, said assembly being interposed between the bolt means and said hammer and providing a secondary firing pin engageable with said hammer and the primary firing pin thereby to strike the primer of a cartridge chambered within the barrel in response to rearward movement of said trigger;

modifying said slide to communicate with said secondary firing pin assembly; and allowing said secondary firing pin mechanism to rotate counter-clockwise and said bolt lock means to rotate clockwise immediately after firing as said slide is driven rearwardly and said bolt means is opened.

11. A method for converting cartridge firing firearms from fully automatic operation to semi-automatic operation, as set forth in claim 10, including the additional step of allowing said secondary firing pin mechanism to rotate clockwise and said bolt lock means to rotate counter-clockwise as said bolt means is closed.

12. A method for converting cartridge firing firearms from fully automatic operation to semi-automatic operation, as set forth in claim 10, including the additional step of providing means on said hammer engageable with a portion of said slide means to cock said hammer as said slide means is driven rearwardly.

13. A method for the semi-automatic operation of a cartridge firing firearm providing, in combination, a receiver; a barrel attached to said receiver; a magazine, supplying a plurality of cartridges, carried by said receiver; said method comprising:

providing bolt means reciprocable within the receiver of the firearm, engageable with the breach of the barrel and the face of a cartridge chambered therein and carrying a primary firing pin;

providing bolt lock means pivotally connected to said bolt means for selectively locking said bolt means within the receiver;

providing a trigger assembly having a trigger and a hammer selectively movable once in response to rearward movement of said trigger;

providing a gas operated slide assembly having a slide movable within said receiver;

providing a secondary firing pin assembly between the bolt lock means and the slide, said assembly being interposed between the bolt means and said hammer and providing a secondary firing pin engageable with said hammer and the primary firing pin thereby to strike the primer of a cartridge chambered within the barrel in response to rearward movement of said trigger; and allowing said secondary firing pin mechanism to rotate counter-clockwise and said bolt lock means to rotate clockwise immediately after firing as said slide is driven rearwardly and said bolt means is opened.

14. A method for converting cartridge firing firearms from fully automatic operation to semi-automatic operation, as set forth in claim 13, including the additional step of allowing said secondary firing pin mechanism to rotate clockwise and said bolt lock means to rotate counter-clockwise as said bolt means is closed.

15. A method for converting cartridge firing firearms from fully automatic operation to semi-automatic operation, as set forth in claim 13, including the additional step of providing means on said hammer engageable with a portion of said slide means to cock said hammer as said slide means is driven rearwardly.

16. A striking mechanism, as set forth in claim 2, further comprising cocking means reciprocable within said receiver and engageable with said secondary firing pin assembly for manual operation of said striking mechanism.

17. A striking mechanism, as set forth in claim 6, further comprising cocking means reciprocable within said receiver and engageable with said secondary firing pin assembly for manual operation of said striking mechanism.

18. A striking mechanism, as set forth in claim 8, further comprising cocking means reciprocable within said receiver and engageable with said secondary firing pin assembly for manual operation of said striking mechanism.

* * * * *